US009273481B2

(12) United States Patent
Cooke

(10) Patent No.: US 9,273,481 B2
(45) Date of Patent: Mar. 1, 2016

(54) POOL CIRCULATION SYSTEMS

(71) Applicant: Cliff Cooke, Victoria (AU)

(72) Inventor: Cliff Cooke, Victoria (AU)

( * ) Notice: Subject to any disclaimer, the term of this patent is extended or adjusted under 35 U.S.C. 154(b) by 410 days.

(21) Appl. No.: 13/708,144

(22) Filed: Dec. 7, 2012

(65) Prior Publication Data

US 2013/0145539 A1 Jun. 13, 2013

(30) Foreign Application Priority Data

Dec. 9, 2011 (AU) ..... 2011253935

(51) Int. Cl.
*E04H 4/00* (2006.01)
*E04H 4/12* (2006.01)

(52) U.S. Cl.
CPC ..... *E04H 4/1245* (2013.01); *E04H 4/1272* (2013.01)

(58) Field of Classification Search
CPC ..... E04H 4/1209
USPC ..... 4/488–513
See application file for complete search history.

(56) References Cited

U.S. PATENT DOCUMENTS

| | | | | |
|---|---|---|---|---|
| 8,281,425 | B2 * | 10/2012 | Cohen | 4/504 |
| 8,820,355 | B2 * | 9/2014 | Sutton et al. | 137/625.11 |
| 2013/0007954 | A1 * | 1/2013 | Sutton et al. | 4/490 |
| 2013/0145539 | A1 * | 6/2013 | Cooke | 4/494 |

* cited by examiner

*Primary Examiner* — Lori Baker
(74) *Attorney, Agent, or Firm* — Boyle Fredrickson, S.C.

(57) ABSTRACT

A water circulation system for a swimming pool includes a venturi skimmer; a pump with a suction side and a discharge side; a suction drain; a pool return line; and at least one pool inlet fluidically connected to the pool return line. A pump inlet on the pump suction side has an inlet selector to fluidically connect the pump to the venturi skimmer, the suction drain, or a combination of the venturi skimmer and the suction drain. In addition, pump outlet on the pump discharge side has an outlet selector to fluidically connect the pump to the venturi skimmer, the pool return line, or a combination of the venturi skimmer and the pool return line. The pump is a multispeed pump or a variable speed pump. Also provided is a method of circulating water for a swimming pool generally comprising this circulation system.

16 Claims, 5 Drawing Sheets

POOL CIRCULATION SYSTEMS

BACKGROUND OF THE INVENTION

1. Field of the Invention

The following invention is directed toward circulation systems for swimming pools.

2. Discussion of the Related Art

For the past 40 odd years the standard pool circulation system on swimming pools has not advanced significantly for standard pools that do not have a built in cleaning system. There have been advancements in pumps, filters, chlorinators etc, but little has been done to improve pool circulation in terms of establishing effective circulation of water within the pool for more effective cleaning and improving the energy efficiency of the system.

The standard pool circulation system has a pump that draws water from a suction skimmer (usually located in the deep end wall of the pool), pushes the water through a filter, and then the water is returned to the pool via a number of wall directional eyeball fittings (usually located in the shallow end wall of the pool). These eyeball fittings can be oriented in various directions in an attempt to get the water moving within the pool.

FIG. 1 provides a general schematic of a standard pool circulation system. This system comprises a standard suction skimmer, a main drain, a standard pool pump system, a pool filter and a return line. The standard pool circulation system usually results in satisfactory circulation of the surface water as well as a majority of the shallow end water. However, dead spots or dead zones are common in the deeper parts of the pool due to the circulation system being ineffective at establishing the circulation of water in these deeper regions.

FIG. 2 provides a general schematic of a typical in-floor plumbing system of a standard pool circulation system. The typical in-floor plumbing system uses two pumps. Two pumps are required to reduce the overall pressure load on the system, and in particular on the filter. One of the pumps recirculates water from the main drains, via a filter and eyeball returns. A second pump is required to recirculate water from the skimming device. Because two pumps are used with independent loops, the pressure applied across the filter is far less than with the single pump system. This can result in the filter having a longer operational life. When one pump is used, it needs to be sized such that it can draw and redistribute water from the skimmer and main drains simultaneously. In this case, the pump needs to be comparatively large. In contrast, with a two pump system, each pump is smaller and can be operated independently of the other pump. However, to maintain a satisfactory level of cleaning in the pool system, it is necessary to operate the pump system recirculating the water from the main drains, and the pump system recirculating water from the skimmer at the same time. By way of comparison, a typical two pump system will require a first pump of approximately 1 horsepower drawing from the main drain, and a second pump of approximately 1.5 to 2 horsepower drawing from the skimmer unit. The total combined power requirement of such a two pump system is approximately 2.5 to 3 horsepower. In contrast, a comparable one pump system would require a pump with a power requirement of approximately 2 to 2.5 horsepower. Generally, one pump systems have a power requirement that is around 0.5 horsepower less than a two pump system. Thus a dual pump system is generally less efficient than the single pump system above, and can be more expensive in terms of capital costs and ongoing maintenance costs.

There is ongoing demand to further increase the efficiency of pool recirculation systems by both lower the operating costs and improving the circulation of water within the pool.

Reference to any prior art in the specification is not, and should not be taken as, an acknowledgment or any form of suggestion that this prior art forms part of the common general knowledge in Australia or any other jurisdiction or that this prior art could reasonably be expected to be ascertained, understood and regarded as relevant by a person skilled in the art.

SUMMARY OF THE INVENTION

It is an object of the present invention to ameliorate one or more of the above mentioned shortcomings of prior pool circulation systems.

In one embodiment of the invention there is provided a single pump water circulation system for a swimming pool comprising: a venturi skimmer; a multispeed pump or a variable speed pump with a suction side and a discharge side; a suction drain; a pool return line; at least one pool inlet, fluidically connected to the pool return line; a pump inlet, for receiving an inlet stream, on the suction side having an inlet selector that is operable such that the pump inlet can be fluidically connected to: the venturi skimmer, the suction drain, or a combination of the venturi skimmer and the suction drain; a pump outlet, for providing an outlet stream, on the discharge side having an outlet selector that is operable such that the pump outlet can be fluidically connected to: the venturi skimmer, or a combination of the venturi skimmer and the pool return line; and wherein the inlet selector and the outlet selector are based on the speed of the pump and/or the volume of water being pumped.

In one aspect of this embodiment, the inlet selector is a three way valve or a two way valve on each line that can be fluidically connected to the pump inlet. In another aspect, the outlet selector is a three way valve or a two way valve on each of the pool return line and a line fluidically connecting the venturi skimmer to the outlet of the pump, or the outlet selector is a two way valve located on the pool return line. In the embodiment where the outlet selector is either a three way valve or a two way valve on each of the pool return line and the line fluidically connecting the venturi skimmer to the outlet of the pump, the outlet selector can fluidically connect the pump to the venturi skimmer, the pool return line, or a combination of the venturi skimmer and the pool return line.

In a further aspect of this embodiment, when the pump inlet is the combination of the venturi skimmer and the suction drain, the proportion of the inlet stream contributed by the venturi skimmer and the suction drain to the inlet stream can be controlled. In yet a further aspect, when the pump outlet is the combination of the venturi skimmer and the pool return line, the proportion of the outlet stream contributed to each of the venturi skimmer and the pool return line can be controlled.

In a further aspect, the circulation system further comprises a control device for controlling at least one of the suction side selector or the discharge side selector. The control device may be interfaced with the pumps internal logic, such that when the speed of the pump is changed, the control device can automatically adjust the outlet selector.

In a further aspect, the circulation system further comprises a sensor for measuring a flow of water to the venturi skimmer on the discharge side of the pump, wherein: the sensor is a flow sensor or a pressure sensor; and the sensor is in communication with the control device.

In a further aspect, the circulation system further comprises a timer for managing the operation of the pump.

In a further aspect of this embodiment, the at least one pool inlet comprises in-floor cleaning heads. These may be pop-up in-floor cleaning heads.

In various aspects, the circulation system may further comprise: a pool filter on the discharge side of the pump, a debris canister on the suction side of the pump, and automatic controlling means for controlling the suction side selector and the discharge side selector. The automatic controlling means may comprise a sensor and a control device. The sensor may be located on a line connecting the discharge side of the pump to the venturi skimmer. The sensor may sense flow rate and/or pressure in the line. The sensor may communicate with the control device to actuate (throttle, partially or fully open, or partially or fully close) the outlet selector on the discharge side of the pump. The control device may also communicate directly with the pump. Actuation of the outlet selector may result in: all of the pump outlet flow being diverted through the pool return line, all of the outlet flow being diverted through the venturi skimmer, a partial amount of the outlet flow being diverted through the pool return line and a partial amount of the outlet flow being diverted through the venturi skimmer. Similarly, actuation of the inlet selector on the suction side of the pump may result in: all of the pump inlet flow being provided from the suction drain, all of the inlet flow being provided by the venturi skimmer, a partial amount of the inlet flow being provided by the suction drain and a partial amount of the inlet flow being provided by the venturi skimmer. Actuation of the pump inlet selector and the pump outlet selector may be manual or automatic.

In another embodiment of the invention there is provided a method of circulating water with a single pump for a swimming pool wherein the swimming pool comprises: a venturi skimmer; a suction drain; at least one pool inlet; the method comprising: providing a multispeed or variable speed pump having a suction side and a discharge side; adjusting an inlet selector on the suction side of the pump providing an inlet stream, wherein adjusting the inlet selector allows an inlet to be selected from the group consisting of: the venturi skimmer, the suction drain, or a combination of the venturi skimmer and the suction drain; and adjusting an outlet selector on the discharge side of the pump providing an outlet stream, wherein adjusting the outlet selector allows an outlet to be selected from the group consisting of: the venturi skimmer, or a combination of the venturi skimmer and the at least one pool inlet; wherein the inlet selector and the outlet selector are adjusted based on the speed of the pump and/or the volume of water being pumped.

In one aspect of this embodiment, the speed of the pump can be used to adjust the proportion of the inlet contributed by the venturi skimmer and the suction drain to the suction side of the pump.

In another aspect, the speed and/or volumetric flow rate of the pump can be used to adjust the proportion of the outlet contributed to the venturi skimmer and to the pool inlet on the discharge side of the pump.

In a further aspect, the inlet on the suction side of the pump is selected using a valve means selected from the group consisting of a three way valve or a two way valve on each line that can be fluidically connected to the pump inlet.

In a further aspect, the outlet on the discharge side of the pump is selected using a valve means selected from the group consisting of: a three way valve, a two way valve on each of the pool return line and a line fluidically connecting the venturi skimmer to the outlet of the pump, or a two way valve on the pool return line. In the embodiment where the outlet selector is either a three way valve or a two way valve on each of the pool return line and the line fluidically connecting the venturi skimmer to the outlet of the pump, the outlet selector can fluidically connect the pump to the venturi skimmer, the pool return line, or a combination of the venturi skimmer and the pool return line.

As used herein, except where the context requires otherwise, the term "comprise" and variations of the term, such as "comprising", "comprises" and "comprised", are not intended to exclude further additives, components, integers or steps.

Further aspects of the present invention and further embodiments of the aspects described in the preceding paragraphs will become apparent from the following description, given by way of example and with reference to the accompanying drawings.

DETAILED DESCRIPTION OF THE EMBODIMENTS

In one aspect, the present invention relates to the use of a single pump water circulation system for a swimming pool that uses a multi-speed or variable speed drive pump. The inventor has found that multi-speed or variable speed pumps are able to be incorporated into the pool circulation system of the present invention to provide increased energy savings over traditional pumps and improved circulation of water within the pool. The speed of the pump can be raised or lowered depending on pool circulation requirements. For example on a medium speed these pumps can turn over half the water as compared to full speed, but use about one third of the power, i.e. half the water turned over at one third the energy cost. However, if a multi-speed or variable speed drive pump is installed onto the standard pool circulation system (as illustrated in FIG. 1) and then put onto half speed, the circulation of water and surface skimming of the pool would become ineffectual.

Accordingly, in another aspect, the present invention relates to an improved water circulation system that comprises a venturi skimmer. The circulation system is similar to a standard pool circulation system, but uses a venturi skimmer in place of a suction skimmer. Furthermore, an active suction drain is installed in the deepest part of the pool. When the pump is activated, water will be drawn from the deepest part of the pool, pushed through the filter and returned to both the venturi skimmer and the standard pool eyeball returns. The venturi skimmer only requires approximately 20% of the return water to operate as if it was a suction skimmer with a pump drawing from it. The use of the venturi skimmer in this system results in improved surface skimming and circulation of shallow end water. It also encourages circulation of water in the deepest parts of the pool. The use of a venturi skimmer has been found to result in more effective water circulation within the pool; ultimately circulating the pool water much more efficiently and effectively through the system to be cleansed via filtration and/or chemical treatment. Furthermore, a suction line may be installed from the venturi skimmer to the pump, so that the pool can be vacuumed when necessary. By actuating a selector on the suction side of the pump, the venturi skimmer can be temporarily turned into a suction skimmer. This may be useful for initiating a vacuuming process. When drawing from the skimmer only, on the lower speeds, the skimmer may still function to some degree.

Figure 1:
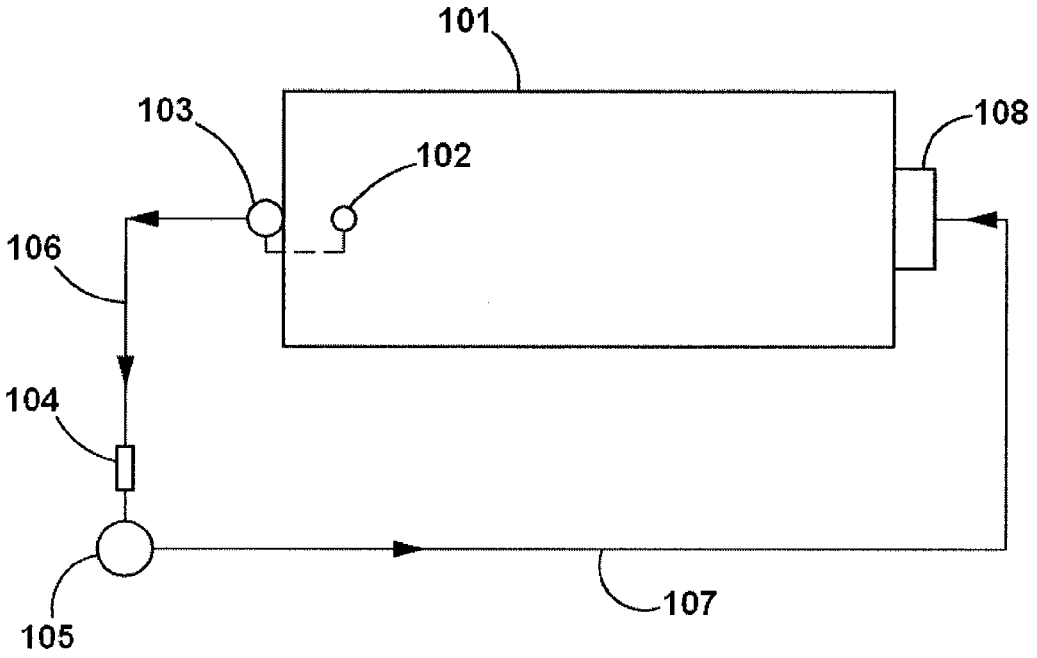
FIGURE 1 (Prior Art)
FIG. 1 is a schematic of a standard hydraulic flow system that is generally used in a pool circulation system.
Figure 2:
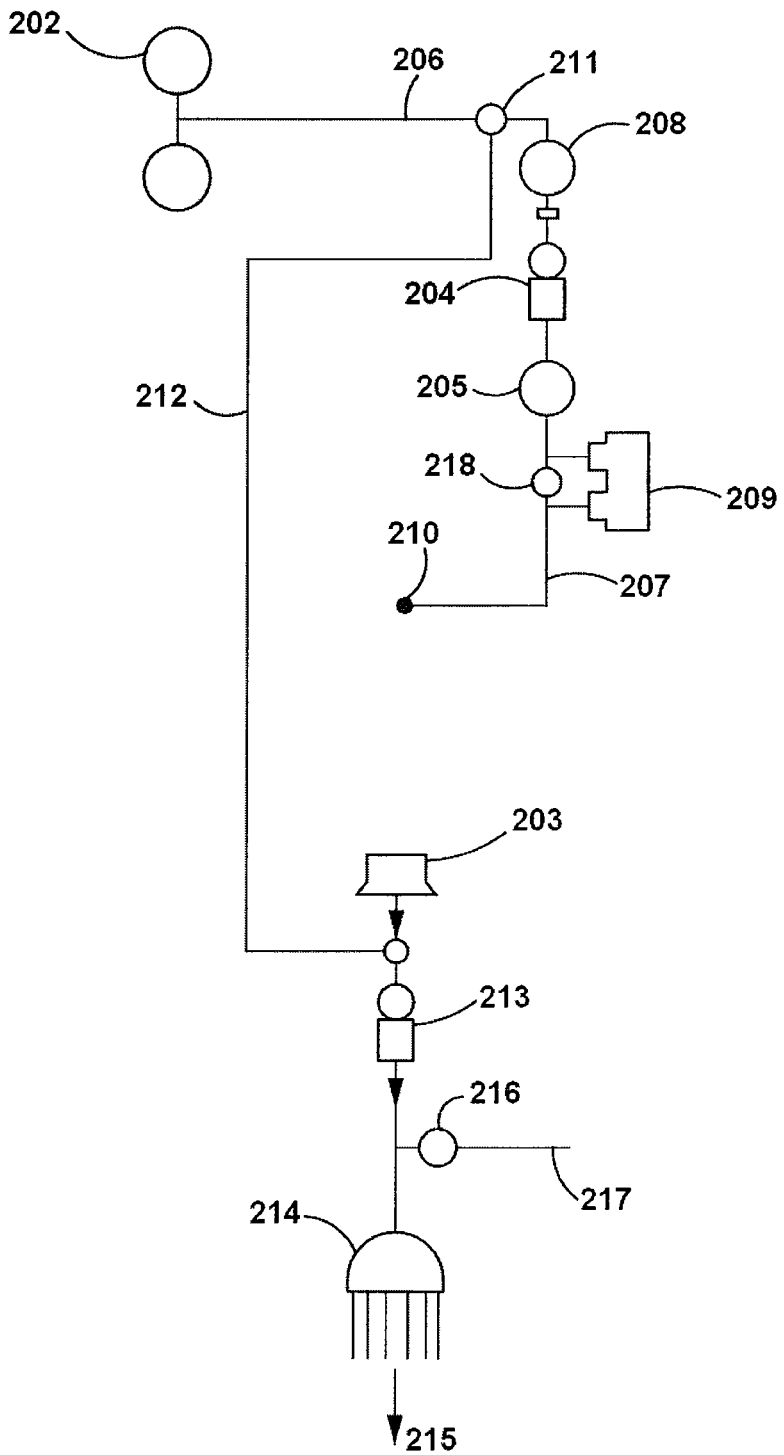
FIGURE 2 (Prior Art)
FIG. 2 is a schematic of a typical in-floor plumbing system of a standard pool circulation system.

FIGS. 1 and 2 provide examples of prior art systems. FIG. 1 shows a pool (101) with a standard hydraulic flow pool circulation system comprising a single standard pump (104). The system comprises a main drain (102) which may not be active, a surface skimmer (103), a standard pump (104), a pool filter (105), a pump inlet line (106), a pump outlet line (107) and a pool inlet (108). FIG. 2 shows a typical in floor two pump plumbing system for a pool. The system comprises: main drains (202), a surface skimmer (203), a first standard pump (204), a filter (205), a suction line from the main drains (206), a pump outlet line (207), a leaf canister (208), an optional salt or chlorination system (209), eyeball returns (210), a valve (211), a vacuum line (212), a second standard pump (213), a water distribution valve (214), in floor heads (215), a two-way valve (216) on a balance line (217) and a two-way valve (218) on the pump outlet line.

Figure 3:
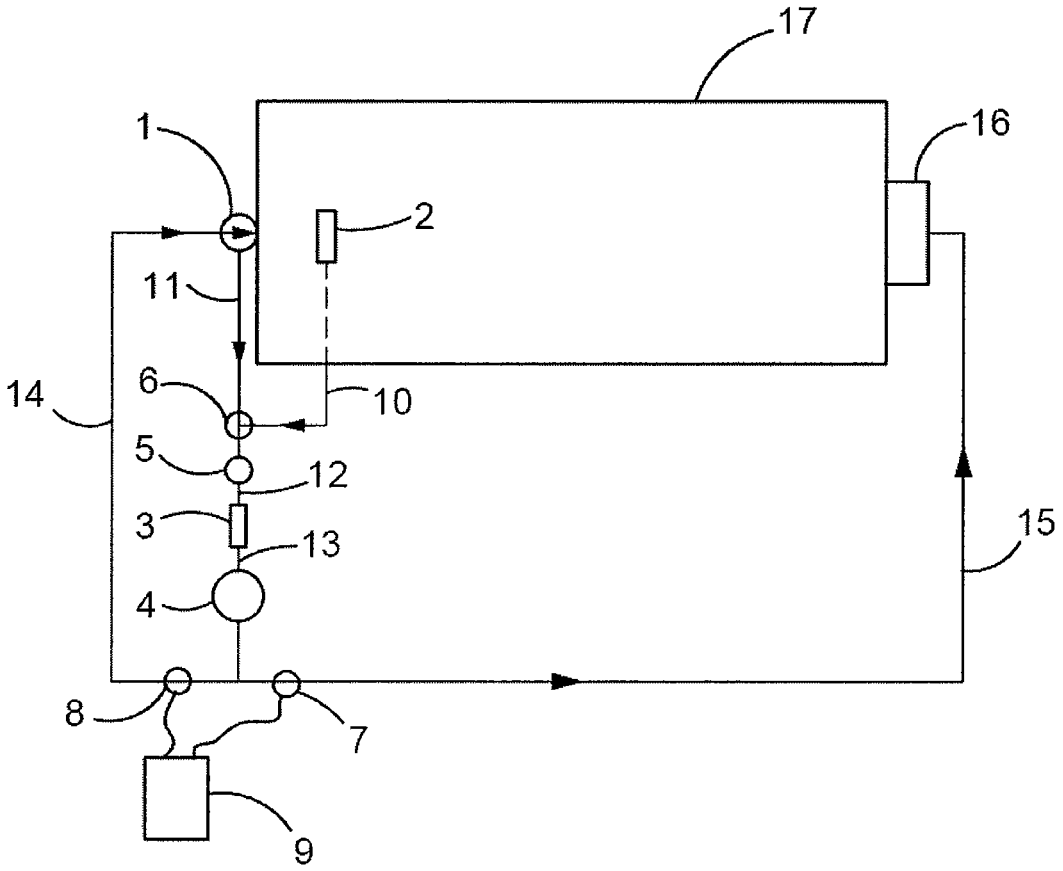
FIG. 3 is a schematic of a pool circulation system comprising a multi-speed or variable speed pump according to an embodiment of the invention.

FIG. 3 provides a schematic of a general embodiment of the invention showing a pool (17) with a pool circulation system. The pool circulation system of FIG. 3 comprises a venturi skimmer (1), a suction drain (2), a multi-speed or variable speed pump (3), a pool filter (4), an optional debris canister (5), a selector (6) on the suction side of the pump, a selector (7) on the discharge side of the pump, an optional sensor (8), an optional control device (9), a line (10) from the suction drain to the selector on the suction side of the pump, a line (11) from the venturi skimmer to the selector on the suction side of the pump, an inlet line (12) to the pump, an outlet line (13) from the pump to the selector on the discharge side of the pump via the pool filter, a line (14) from the outlet line to the venturi skimmer, a pool return line (15) from the selector on the discharge side of the pump to the pool inlet (16).

In this embodiment, it is preferred that selector (6) is a three way valve and that selector (7) is a two-way valve. However, other suitable selector arrangements may be employed, for example selector (7) may be a three-way valve that is located at the junction of lines 13, 14 and 15. Preferably, selector (7) is a two way valve that can be manually operated or automatically operated. Selector (7) is able to be adjusted to suit a range of varying flow rates. In the case where the selector (7) can be automatically operated, the system includes a sensor (8) and a control device (9). The sensor measures the flow of water in line (14) and provides the flow data to the control device (9); the control device can then automatically adjust the two-way valve (7) if required.

When the pump is operating on full speed, the venturi skimmer will be operating at peak performance and the cleaning heads will be delivering the required water volume and pressure to operate the cleaning heads. However, if an owner/operator then switches the pump to a low or medium speed, or somewhere in between either by manual or by automatic means, the flow and pressure will drop in the system and the skimming and cleaning functions will begin to operate less efficiently. To mitigate this drop in efficiency, the present embodiment includes a selector on the discharge side of the pump, such as a two-way valve, that can be throttled to maintain the flow of water to the venturi skimmer at a suitable flow rate. This selector can be either manually or automatically actuated. In a preferred embodiment, the system further comprises a sensor that will detect a change of flow or pressure in line (14). This will communicate with a control device which can control the selector (7). In the case where the selector is a valve, the valve may be a motorized valve. The selector may be controlled to divert more of the return flow and pressure to the venturi skimmer, so that while the pump is operating on low speeds, the venturi skimmer will be operating at peak performance; skimming and removing dust, leaves, debris and pollutants that enter the pool. Preferably, this will still allow water to be drawn from the deepest parts of the pool.

As above, when the pump is operating at low speeds, the system is thus optimised by adjusting the selector, which in this embodiment this corresponds to throttling valve (7). However, if an owner/operator then switches the pump to a higher speed either by manual or by automatic means, the flow and pressure will increase within the system. This may result in the circulation system being run with less energy efficiency. To mitigate this drop in efficiency, the selector can be adjusted to decrease the flow of water to the venturi skimmer and increase the flow of water via pool return line (15). This selector can be either manually or automatically adjusted. In a preferred embodiment, the system includes a sensor that will detect a flow or pressure increase in line (14). This will communicate with a control device which can control the selector (7). The valve may be controlled to divert more of the return flow and pressure through the pool return line.

The improvement in this system means that when running on full speed, dirt and debris is being removed from both the floor and surface of the pool and on lower speeds, the system will automatically adjust, or can be manually adjusted so that peak skimming is still maintained and that the lower flow of water through the circulation system is being distributed between the venturi skimmer and the pool return line in the most effective and efficient manner. Then, conversely, if the speed of the pump is increased, the system can either be manually or automatically adjusted to ensure the effective and efficient circulation of water within the system.

In one aspect of the invention, the control unit may interface with the pumps internal logic such that when the speed of the pump is changed, the control device can automatically adjust the selector to ensure that the correct flow is being diverted to the venturi skimmer, thus maintaining efficient operation of the circulation system.

In another aspect of the invention, operation of the pump may be automated. For example, the operation of the pump may be managed by a scheduling device, such as a timer, wherein the pump is activated or deactivated or the speed of the pump is increased or decreased according to a schedule (i.e. this allows the pump to be switched on, off, or to vary flow rates automatically). An operator may select what hours of cleaning and filtering are desired based on their individual pool needs. This may for example be to ensure energy savings during off peak power consumption periods.

Figure 4:
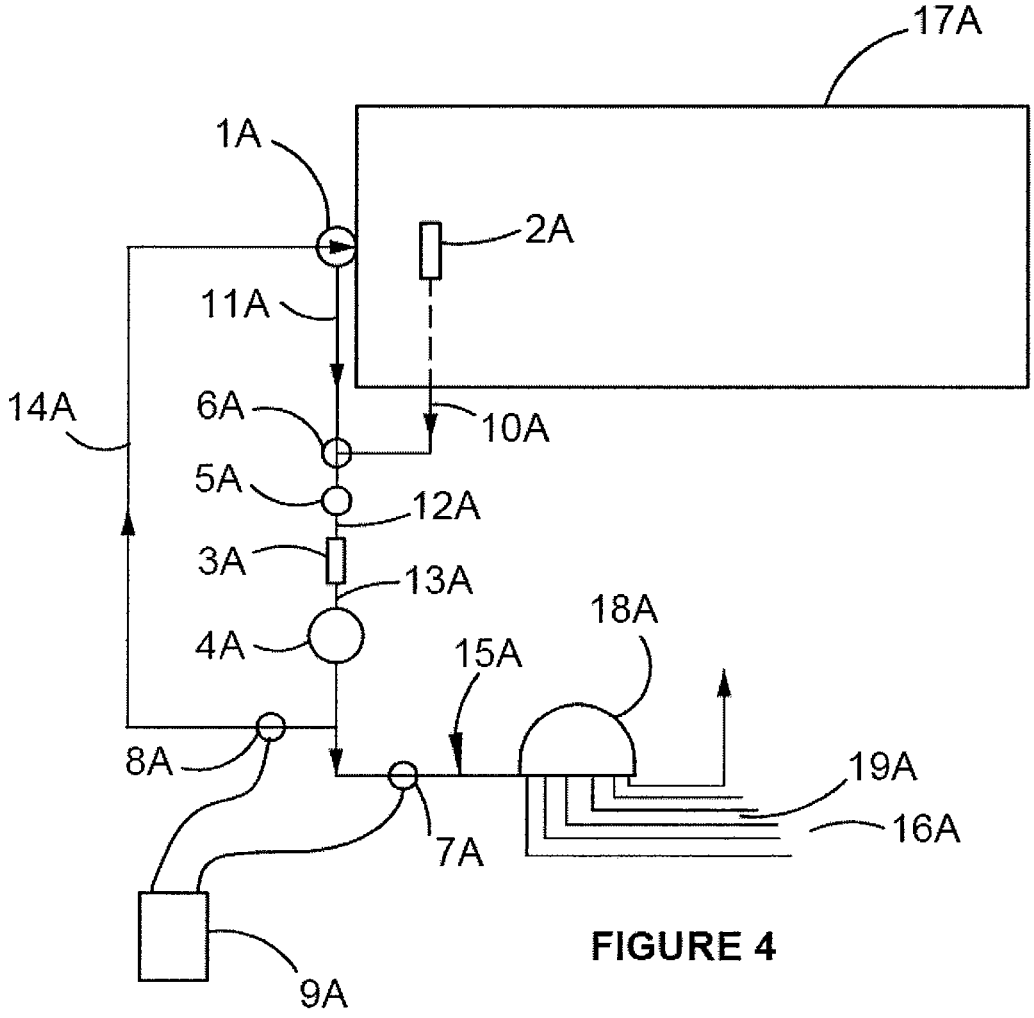
FIG. 4 is a schematic of a pool circulation system comprising a multi-speed or variable speed pump according to another embodiment of the invention.

FIG. 4 is a schematic of another embodiment of the invention showing a pool (17A) with a pool circulation system. The pool circulation system of FIG. 4 comprises a venturi skimmer (1A), a suction drain (2A), a multi-speed or variable speed pump (3A), a pool filter (4A), an optional debris canister (5A), a selector (6A) on the suction side of the pump, a selector (7A) on the discharge side of the pump, an optional sensor (8A), an optional control device (9A), a line (10A) from the suction drain to the selector on the suction side of the pump, a line (11A) from the venturi skimmer to the selector on the suction side of the pump, an inlet line (12A) to the pump, an outlet line (13A) from the pump to the selector on the discharge side of the pump via the pool filter, a line (14A) from the selector on the discharge side of the pump to the venturi skimmer, a pool return line (15A) from the selector on the discharge side of the pump to the pool inlets (16A) via a water distribution valve (18A) and inlet return lines (19A).

In this embodiment, the pool inlets (16A) are in-floor cleaning heads. Water is distributed to a water distribution valve (18A) which distributes water over a number of inlet return lines (19A). The inlet return lines feed water to a number of in-floor cleaning heads. The in-floor cleaning heads may comprise a series of pop up cleaning heads. These heads deliver water that will either send the dirt/debris down to the active drain/drains in the deepest part of the floor of the pool, and/or send the dirt/debris into suspension so that it can be extracted by the venturi skimmer.

While this embodiment illustrates water being returned to the pool via in-floor cleaning heads, any suitable means for returning water to the pool may be used. Furthermore, whilst this embodiment has some differences from the embodiment described in FIG. 3, many of the features discussed in relation to FIG. 3 are equally applicable to this embodiment.

In this embodiment, it is preferred that selector (6A) is a three way valve and selector (7A) is a two way valve. More preferably, selector (7A) is a two way valve that can be manually operated or automatically operated. Selector (7A) is able to be adjusted to suit a range of varying flow rates. In the case where the selector (7A) can be automatically operated, the system includes sensor (8A) and control device (9A). The sensor measures the flow of water in line (14A) and provides the flow data to the control device (9A); the control device can then automatically adjust the two way valve (7A) if required.

In this embodiment, during pump operation, water is continuously returned to the venturi skimmer (1A) from the pump (3A) via line (14A). The selector (7A) installed on the pool return line (15A) can be adjusted to improve the efficiency of the pool circulation system depending on the flow of water through the system. In the case where the selector is a two-way valve, the valve may be adjusted by throttling, closing or opening (partially or completely). When the pump is switched from high speed down to medium or low speed, the owner/operator can manually adjust the selector to direct more return water to the venturi skimmer. In the situation where the selector is a two-way valve, the adjustment may be the complete or partial closing of the valve. This adjustment of the selector will result in the cessation or a reduction in water being returned via the pool return line. However, water will still be returned to the pool via the venturi skimmer. Water will still be drawn from the floor of the pool and the surface of the pool will still be skimmed to remove dust, leaves, debris and other pollutants. Due to the increased proportion of flow being diverted to the venturi skimmer, the venturi skimmer may still perform with these lower flows being provided from the pump as if the suction skimmer was operating with the pump fully drawing water at the high speed settings.

When the pump is switched to a lower speed, the selector may also be operated automatically, for example the selector may be a two-way valve having a motorized actuator, so that when the pump is switched either automatically or manually to a lower speed, this change in speed may be detected and the selector adjusted accordingly to direct the appropriate flow to the venturi skimmer to maintain peak performance. As discussed with regard to the previous embodiment, automatic operation of the selector can be achieved by including a sensor device (8A) in line (14A) which can measure the pressure and/or flow in line (14A) or through communication between the control device and the internal logic of the pump. The controller (9A) can then adjust the selector accordingly.

When the pump is switched back to full speed, the increase in flow/pressure will be detected again and the selector will be actuated to allow more flow to the return pool line (15A) while maintaining peak performance operation of the skimmer. In the case where the selector is a two-way valve, the valve may be opened, either partially or completely.

Figure 5:
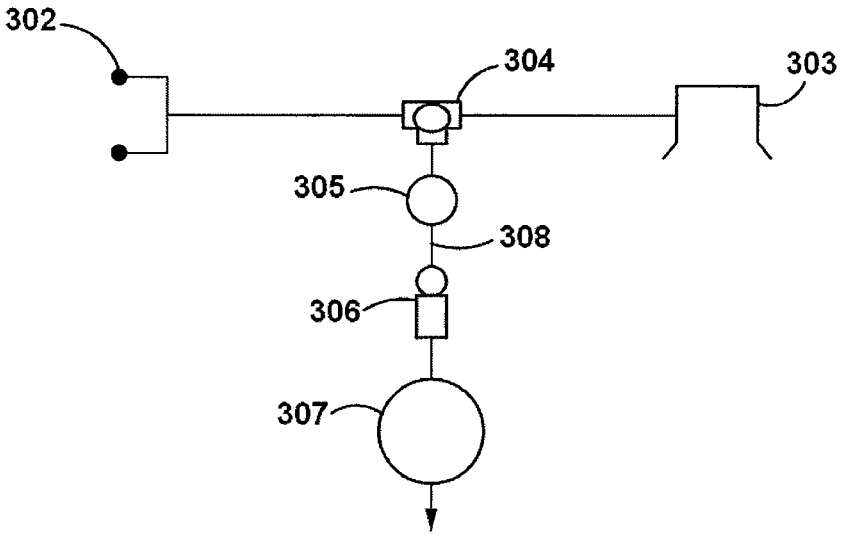
FIGS. 5 and 6 are schematics showing valve arrangements according to various embodiments of the invention.
Figure 6:
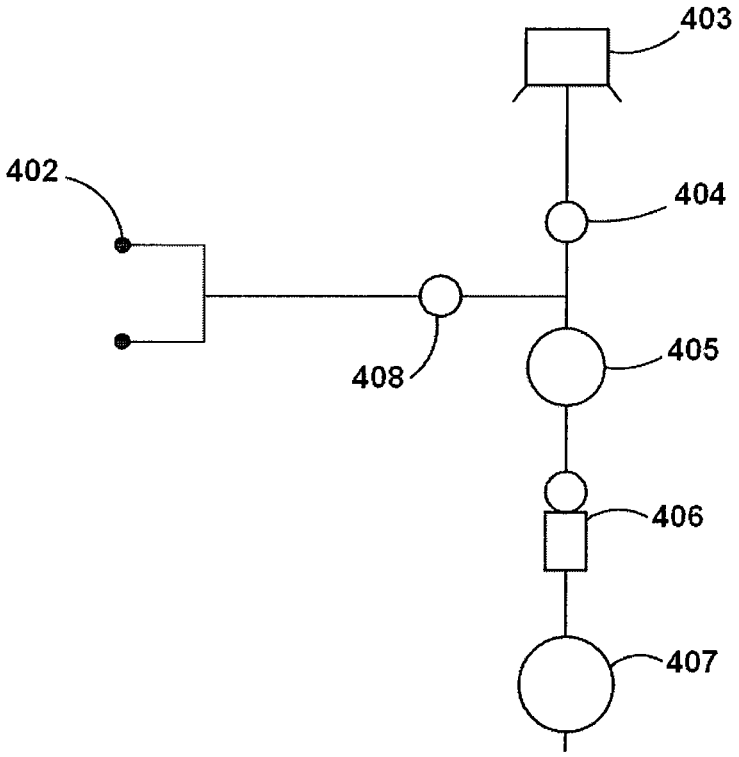

FIGS. 5 and 6 provide alternative arrangements for the selectors on the suction side of the pump.

FIG. 5 shows a selector (304) comprising a three-way valve that connects both the skimmer (303) and the main drains (302) to the inlet line (308) to the pump (306). This allows selection of the skimmer, or the main drains, or both the skimmer and the main drains as the inlet to the pump. This particular embodiment includes a leaf canister (305) on the suction side of the pump and a filter (307) on the discharge side of the pump.

FIG. 6 shows a similar system, except independent two way valves, i.e. valves (404) and (408), have been installed to individually control the selection of the skimmer (403), or the main drains (402), or both the skimmer and the main drains as the inlet to the pump (406). This particular embodiment also includes a leaf canister (405) on the suction side of the pump and a filter (407) on the discharge side of the pump.

It will be understood that the invention disclosed and defined in this specification extends to all alternative combinations of two or more of the individual features mentioned or evident from the text or drawings. All of these different combinations constitute various alternative aspects of the invention.

What is claimed is:

1. A single pump water circulation system for a swimming pool comprising:

a venturi skimmer;

a multispeed pump or a variable speed pump with a suction side and a discharge side;

a suction drain;

a pool return line;

at least one pool inlet, fluidically connected to the pool return line;

a pump inlet, for receiving an inlet stream, on the suction side having an inlet selector that is operable such that the pump inlet can be fluidically connected to: the venturi skimmer, the suction drain, or a combination of the venturi skimmer and the suction drain;

a pump outlet, for providing an outlet stream, on the discharge side having an outlet selector that is operable such that the pump outlet can be fluidically connected to: the venturi skimmer, or a combination of the venturi skimmer and the pool return line; and wherein the inlet selector and the outlet selector are adjusted based on the speed of the pump and/or the volume of water being pumped.

2. The circulation system of claim 1, wherein when the pump inlet is the combination of the venturi skimmer and the suction drain, the proportion of the inlet stream contributed by the venturi skimmer and the suction drain to the inlet stream can be controlled.

3. The circulation system of claim 1, wherein when the pump outlet is the combination of the venturi skimmer and the pool return line, the proportion of the outlet stream contributed to each of the venturi skimmer and the pool return line can be controlled.

4. The circulation system of claim 1, wherein the inlet selector is selected from the group consisting of a three way valve or a two way valve on each line that can be fluidically connected to the pump inlet.

5. The circulation system of claim 1, wherein the outlet selector is selected from the group consisting of:

a three way valve;

a two way valve on each of the pool return line and a line fluidically connecting the venturi skimmer to the outlet of the pump; or a two way valve on the pool return line;

wherein when the outlet selector is either a three way valve or a two way valve on each of the pool return line and the line fluidically connecting the venturi skimmer to the outlet of the pump, the outlet selector can fluidically connect the pump to the venturi skimmer, the pool return line, or a combination of the venturi skimmer and the pool return line.

6. The circulation system of claim 1, further comprising a control device for controlling at least one of the suction side selector or the discharge side selector.

7. The circulation system of claim 6, wherein the control device is interfaced with the pumps internal logic, such that when the speed of the pump is changed, the control device can automatically adjust the outlet selector.

8. The circulation system of claim 6, further comprising a sensor for measuring a flow of water to the venturi skimmer on the discharge side of the pump, wherein: the sensor is a flow sensor or a pressure sensor; and the sensor is in communication with the control device.

9. The circulation system of claim 1, further comprising a timer for managing the operation of the pump.

10. A method of circulating water in a swimming pool comprising the circulation system of claim 1.

11. A method of circulating water with a single pump for a swimming pool wherein the swimming pool comprises:

a venturi skimmer;

a suction drain;

at least one pool inlet;

the method comprising:

providing a multispeed or variable speed pump having a suction side and a discharge side;

adjusting an inlet selector on the suction side of the pump providing an inlet stream, wherein adjusting the inlet selector allows an inlet to be selected from the group consisting of: the venturi skimmer, the suction drain, or a combination of the venturi skimmer and the suction drain; and adjusting an outlet selector on the discharge side of the pump providing an outlet stream, wherein adjusting the outlet selector allows an outlet to be selected from the group consisting of the venturi skimmer, or a combination of the venturi skimmer and the at least one pool inlet;

wherein the inlet selector and the outlet selector are adjusted based on the speed of the pump and/or the volume of water being pumped.

12. The method of claim 11, wherein the speed of the pump can be used to adjust the proportion of the inlet stream contributed by the venturi skimmer and the suction drain to the suction side of the pump.

13. The method of claim 11, wherein the speed and/or volumetric flow rate of the pump can be used to adjust the proportion of the outlet stream contributed to each of the venturi skimmer and the pool inlet on the discharge side of the pump.

14. The method of claim 11, wherein the inlet on the suction side of the pump is selected using a valve means selected from the group consisting of a three way valve or a two way valve on each line that can be fluidically connected to the pump inlet.

15. The method of claim 11, wherein the outlet on the discharge side of the pump is selected using a valve means selected from the group consisting of:

a three way valve;

a two way valve on each of the pool return line and a line fluidically connecting the venturi skimmer to the outlet of the pump; or a two way valve on the pool return line;

wherein when the outlet selector is either a three way valve or a two way valve on each of the pool return line and the line fluidically connecting the venturi skimmer to the outlet of the pump, the outlet selector can fluidically connect the pump to the venturi skimmer, the pool return line, or a combination of the venturi skimmer and the pool return line.

16. The method of claim 11, wherein the circulation system further comprises a control device that can automatically adjust the outlet selector in response to a change in speed and/or volumetric flow rate of the pump.

* * * * *